US005422215A

United States Patent [19]

Takagi et al.

[11] Patent Number: 5,422,215

[45] Date of Patent: Jun. 6, 1995

[54] MAGNETIC TONER

[75] Inventors: Seiichi Takagi, Yokohama; Makoto Unno, Tokyo, both of Japan

[73] Assignee: Canon Kabushiki Kaisha, Tokyo, Japan

[21] Appl. No.: 186,884

[22] Filed: Jan. 26, 1994

Related U.S. Application Data

[63] Continuation of Ser. No. 884,280, May 13, 1992, abandoned, which is a continuation of Ser. No. 598,436, Oct. 16, 1990, abandoned.

[30] Foreign Application Priority Data

| | | | |
|---|---|---|---|
| Oct. 17, 1989 | [JP] | Japan | 1-271053 |
| Oct. 17, 1989 | [JP] | Japan | 1-271055 |
| Nov. 14, 1989 | [JP] | Japan | 1-294038 |

[51] Int. Cl.[6] ..... G03G 9/083

[52] U.S. Cl. ..... 430/106.6; 430/111; 430/703

[58] Field of Search ..... 430/106.6, 903, 111

[56] References Cited

U.S. PATENT DOCUMENTS

| | | | |
|---|---|---|---|
| 2,221,776 | 11/1940 | Carlson | 95/5 |
| 2,297,691 | 10/1942 | Carlson | 95/5 |
| 2,618,552 | 11/1952 | Wise | 95/1.9 |
| 2,874,063 | 2/1959 | Greig | 117/17.5 |
| 3,666,363 | 5/1972 | Tanaka et al. | 96/1 R |
| 3,909,258 | 9/1975 | Kotz . | |
| 3,914,181 | 10/1975 | Berg et al. | 430/903 |
| 4,125,667 | 11/1978 | Jones | 430/106.6 |
| 4,495,268 | 1/1985 | Miyakawa | 430/122 |
| 4,543,312 | 9/1985 | Murakawa et al. | 430/106.6 |
| 4,803,142 | 2/1989 | Takagi et al. | 430/106 |
| 4,902,596 | 2/1990 | Koishi et al. | 430/106.6 |
| 4,904,558 | 2/1990 | Nagatsuka et al. | 430/106.6 |
| 4,939,060 | 7/1990 | Tomiyama et al. | 430/106.6 |

FOREIGN PATENT DOCUMENTS

| | | | |
|---|---|---|---|
| 314459 | 5/1989 | European Pat. Off. | 430/106.6 |
| 331425 | 9/1989 | European Pat. Off. | 430/106.6 |
| 331426 | 9/1989 | European Pat. Off. | 430/106.6 |
| 2518274 | 6/1983 | France | G03G 9/08 |
| 42-23910 | 11/1967 | Japan . | |
| 43-24748 | 11/1968 | Japan . | |
| 55-18656 | 2/1980 | Japan . | |
| 56-91242 | 7/1981 | Japan . | |
| 58-169153 | 10/1983 | Japan . | |
| 62-051208 | 10/1987 | Japan . | |

OTHER PUBLICATIONS

Patent Abstracts of Japan, vol. 10, No. 119 (p. 453) (2176), May 6, 1986.

Patent Abstracts of Japan, vol. 13, No. 540 (p. 969) (3888), Dec. 5, 1989.

*Primary Examiner*—Christopher D. Rodee

*Attorney, Agent, or Firm*—Fitzpatrick, Cella, Harper & Scinto

[57] ABSTRACT

A magnetic toner comprises a binder resin and a magnetic material.

The magnetic toner has a volume average particle diameter of not more than 9 μm and the variation coefficient of particle size distribution, $(\sigma T/D)\times 100$, of the magnetic toner satisfies the following condition:

$$25 \leqq (\sigma T/D)\times 100 \leqq 35$$

where D represents a volume average particle diameter (μm) of the magnetic toner and $\sigma T$ represents a value of standard deviation of the volume particle size distribution of the magnetic toner, The magnetic material has a number average particle diameter of from 0.1 μm to 0.2 μm and the variation coefficient of particle size distribution, $(\sigma/\overline{X})\times 100$, of the magnetic material satisfies the following condition:

$$(\sigma/\overline{X})\times 100 \leqq 40$$

where $\overline{X}$ represents a number average particle diameter (μm) of the magnetic material and $\sigma$ represents a value of standard deviation of the number particle size distribution of the magnetic material.

18 Claims, No Drawings

MAGNETIC TONER

This application is a continuation of application Ser. No. 07/884,280 filed May 13, 1992, now abandoned, which in turn, is a continuation of application Ser. No. 07/598,436, filed Oct. 16, 1990, now abandoned.

BACKGROUND OF THE INVENTION

1. Field of the invention

The present invention relates to a toner used for image forming processes such as electrophotography and electrostatic recording, and more particularly to a magnetic toner.

2. Related Background Art

A large number of methods have been conventionally known as electrophotography, as disclosed in U.S. Pat. No. 2,297,691, Japanese Patent Publication No. 42-23910 (U.S. Pat. No. 3,666,363) and Japanese Patent Publication No. 43-24748 (U.S. Pat. No. 4,071,361), etc. In general, copies are obtained by forming an electrostatic latent image on a photosensitive member utilizing a photoconductive material and according to various means, subsequently developing the latent image by the use of toner to form it into a visible image, and transferring the toner image to a transfer medium such as paper if necessary, followed by fixing by the action of heat, pressure or heat-and-pressure.

Developing methods in which an electrostatic latent image is formed into a visible image by the use of a toner are also known in variety. For example, developing methods such as the magnetic brush development as disclosed in U.S. Pat. No. 2,874,063, the cascade development as disclosed in U.S. Pat. No. 2,618,552, the powder cloud development as disclosed in U.S. Pat. No. 2,221,776, the fur brush development and the liquid development are known in the art. Of these developing methods, the magnetic brush development, the cascade development and the liquid development that employ a developer mainly composed of a toner and a carrier have been widely put into practical use. These methods are superior methods that can obtain a good image in a relatively stable state, but on the other hand have the problems that the carrier may undergo deterioration and the mixing ratio between the toner and the carrier may change.

To avoid such problems, various proposals have been made on developing methods in which a one-component type developer comprised of only a toner is used. In particular, many advantages are seen in methods in which a developer comprised of toner particles having magnetic properties is used.

U.S. Pat. No. 3,909,258 proposes a method in which development is carried out using a magnetic toner having an electrical conductivity. According to this method, a conductive magnetic toner is supported on a cylindrical conducting sleeve having a means for generating an magnetic field, as exemplified by a magnet, and then the toner is brought into contact with an electrostatic image to carry out development. In this instance, in a developing zone, toner particles form a conducting path between the surface of a recording member and the surface of the sleeve. Charges are led from the sleeve to the toner particles through this conducting path, and the toner particles are adhered to an image area by the Coulomb force that acts between the toner particles and the image area of the electrostatic image. Thus, toner particles are adhered to the image area and the electrostatic image is developed. The developing method using this conductive magnetic toner is a superior method that has avoided the problems involved in the conventional two-component developing methods. On the other hand, since the toner is conductive, this method has the problem that it is difficult to electrostatically transfer a developed image from the recording member to an image support member such as plain paper.

As a developing method that uses a high-resistivity magnetic toner feasible for electrostatic transfer of a developed image, there is a method in which the dielectric polarization of toner particles is utilized. Such a method, however, has the problems that it can only achieve a fundamentally low developing speed and the developed image can not have a sufficient density.

As another developing method that uses a high-resistivity magnetic toner, a method is known in which toner particles are triboelectrically charged by the friction between the toner particles or each particle and a sleeve, and the toner particles thus charged are brought into contact with an electrostatic image supporting member to carry out development. This method, however, has the problems that the triboelectricity of a toner tends to become insufficient because of less contact occasions between toner particles and a friction member such as the sleeve, and the charged toner particles tend to be agglomerated on the sleeve as a result of an increase in the Coulomb force between the toner particles and the sleeve.

Japanese Patent Application Laid-open No. 55-18656 (corresponding to U.S. Pat. No. 4,395,436) proposes a novel developing method that has eliminated the above problems. According to this method, a magnetic toner is coated on a sleeve in a very small thickness, and the magnetic toner is triboelectrically charged. Then the magnetic toner layer is brought into close proximity to an electrostatic image to carry out development. This method can obtain an excellent toner image for the following reasons: i) The coating of a magnetic toner on a sleeve in a very small thickness has increased the occasions of contact between the sleeve and the toner and thus has enabled sufficient triboelectric charging, ii) the magnetic toner is supported on the sleeve by the action of a magnetic force, and also a magnet built in the sleeve and the magnetic toner are relatively moved so that the agglomeration between magnetic toner particles can be loosened and the magnetic toner can be brought into sufficient friction with the sleeve, and iii) since the magnetic toner is supported on the sleeve by the action of a magnetic force and the development is carried out in such a state that the magnetic toner on the sleeve is opposed to the electrostatic image without contact with it, the background fog can be prevented. It is characteristic of a developing device used in such a developing method that its structure can be simple and its size can be made very small.

For example, in a high-speed machine that employs such a developing device, a photosensitive member (e.g., a photosensitive drum) can have room around its circumference. Hence, there are advantages such that it becomes easy to arrange several developing devices having toners with different colors so that colors of toners can be changed at a single operation, or to use laser light simultaneously with analogue light so that the page number or letters can be written simultaneously with copying.

Since in a small-sized machine, the developing device can be made light-weight and small, and hence the technique for the above developing device is nowadays indispensable for making adaptation of copying machines for personal use.

In the field of printers, as typified by a small-sized laser beam printer (LBP), it has become very important for a developing device to require only a small space and be simple and light-weight, in order to provide noiseless and a high-speed printout compared with dot printers or thermal printers.

On the other hand, since this developing system is characterized by the simple, light-weight and small-sized developing device, there is the problem that toners used in this system must have higher performance than conventional toners (e.g., toners used in two-component developers) so that the image quality, durability and stability which are excellent as a whole can be obtained. The performance of the system often reflects the performance of such magnetic toners as it is.

In particular, as for copying machines themselves, those in which digital latent images are used have become available in place of conventional ones of an analogue type, and hence it has become possible to form latent images with much more resolution than ever. A magnetic toner that can well follow such fine latent images must be capable of performing development in a high resolution. In addition, since the copying machines are also tending toward high-speed copying, a magnetic toner used therefor must now be able to satisfy the high resolution, high-speed development and high durability.

In the case of printers also, there are similar demands for high performance. From the viewpoint of high durability, printers, which are used as output units of computers, must print out very frequently and are required to have much severer performance for durability than copying machines.

Toner images are no longer satisfactory only if they are monotonously black. In the case of copying machines, it is particularly demanded that photographs can also be faithfully reproduced, in other words, their middle tones or halftones can be reproduced. In the copying machine of a digital latent image type, the halftone is expressed according to the difference in the density of lines, and hence it becomes difficult to reproduce halftones of an original unless the lines have the same thickness.

Such tone reproduction is highly required particularly in the printers of a digital latent image type. Conventional magnetic toners have a tendency not to be well capable of forming images stably having the same halftones at the both initial stage and final stage of the duration for printing on a large number of sheets.

As for environmental stability, copying machines and LBPs are nowadays often used in severer environments. Because as copying machines have been adapted to personal use or LBPs have become inexpensive, they have become wide-spread for domestic use. In particular, under a condition that a copying machine is placed in a poor environment at home for many days, and during which several copies are occasionally taken, magnetic toners are required to have a very high performance in view of image stability and environmental stability.

Japanese Patent Application Laid-open No. 56-91242 (corresponding to U.S. Pat. No. 4,485,613) and Japanese Patent Publication No. 59-27901 (corresponding to U.S. Pat. No. 4,495,268) propose magnetic toners in which a magnetic material of cubic crystals preferably having a particle diameter of not less than 0.3 μm is used. Such a magnetic material is noted to have a good development efficiency and transfer efficiency and cause less black spots around line images and less background stain. However, when this magnetic material is used in a magnetic toner having a volume average particle diameter of smaller than 10 μm, the amount of static charge of the magnetic toner tends to increase. Therefore, taking account of environmental stability, it is sometimes difficult to control the amount of static charge of the magnetic toner. It is proposed in Japanese Patent Application Laid-open No. 1-112253 (corresponding to European Patent Application Publication No. 0314459) to make smaller the particle diameter of a magnetic toner. According to this proposal, the volume average particle diameter of a magnetic toner which usually distributes between 10 and 14 μm is controlled to be 4 to 9 μm and also the particle size distribution of the magnetic toner is defined. Use of this magnetic toner brings about improvements in fine-line reproduction, halftone reproduction and tone reproduction.

However, in order to answer the recent severe demands, it is sought to further improve the magnetic toners having small particle diameters.

Among materials used in magnetic toners, the magnetic material, in particular, has a great influence on the performance of a magnetic toner since it is contained in an amount of from 20 to 70% by weight based on the total magnetic toner.

Japanese Patent Application Laid-open No. 58-169153 proposes a magnetic toner containing magnetic powder having such a particle size distribution that 50% number average particle diameter ranges from 0.3 to 1.0 μm, a 50% weight average particle diameter ranges from 0.4 to 1.3 μm, and the particle diameter giving a maximum value in the number particle size distribution ranges from 0.4 to 1.3 μm. This magnetic toner is noted to give good image fidelity and stability, well remove background fogging development, and also promise a high resolution and a high density, as well as good environmental characteristics.

It is true that such a magnetic toner has performance sufficient for practical use when used in conventional analogue type machines, but this toner can no longer be said to be sufficient for the high-speed development and high durability when used in recently available high-speed machines of not less than 50 sheets per minute, and also for the high gradation, the high resolution to digital latent images and the fine-line reproduction in digital latent images.

In particular, in order to stably form images with halftones for a long period of time, the above magnetic toner can not be said to have sufficient performance, and the above magnetic powder is insufficient when used in a magnetic toner with a small particle diameter.

Japanese Patent Application Laid-open No. 58-87951 (corresponding to U.S. Pat. No. 4,543,312 proposes that magnetic materials having such particle size distributions that the 50% particle diameter (calculated based on volume) ranges from 1.5 to 4.5 μm, the 20% particle diameter (calculated based on volume) ranges from 1.0 to 4.0 μm and the 75% particle diameter (calculated based on volume) ranges from 2.5 to 6.0 μm should be used. These magnetic powders are for use in color magnetic toners, and are not suitable for use in black image formation. These magnetic toners are insufficient in blackness, and are not preferable.

Japanese Patent Publication No. 62-51208 proposes a magnetic toner that posesses improved dispersibility of a magnetic material to a resin by using a spherical magnetic material and can thereby form a toner image with a high image density. It is true that the spherical magnetic material has such advantages, but it tends to have higher electrical resistance. Circumstances may become severer when the magnetic toner containing the spherical magnetic material has a small particle diameter, which is liable to be charged up in a high-speed machine or small-sized machine. In general, when a magnetic toner has been charged up, it becomes difficult for the magnetic toner to be separated from a toner-carrying member such as a developing sleeve, so that the image density may sometimes be lowered. Moreover, the fogging phenomenon that the background is stained may sometimes occur.

For example, in order to simply achieve a high resolution and a high fine-line reproduction by the use of such a magnetic toner having a small particle diameter, it might be understood to decrease the amount of the magnetic toner applied to fine line images so that no excessive magnetic toner may form black spots around line images. This method, however, brings about a lowering of image density at black solid areas, and hence is not preferable. An attempt to simply increase the image density tends to cause stains on the background. In particular, if the magnetic toner is left to stand in an environment of low temperature and low humidity for a long period of time, the stains on the background may sometimes become conspicuous. When magnetic toners are used, it is not easy to achieve a high image density and a high resolution and to make an image free from stains on the background.

SUMMARY OF THE INVENTION

An object of the present invention is to provide a magnetic toner that has solved the above-mentioned problems.

Another object of the present invention is to provide a magnetic toner having developability with a particularly high resolution.

Still another object of the present invention is to provide a magnetic toner that can give stable developed images even in the high-speed development.

A further object of the present invention is to provide a magnetic toner having superior durability.

A still further object of the present invention is to provide a magnetic toner having a particularly superior tone reproducibility.

A still further object of the present invention is to provide a magnetic toner that can achieve superior halftone and fine-line reproduction and can stably retain sharpness for a long period of time.

A still further object of the present invention is to provide a magnetic toner having a superior environmental stability.

A still further object of the present invention is to provide a magnetic toner that can always give stable images for a long period of time even when a machine is not frequently used.

A still further object of the present invention is to provide a magnetic toner that can achieve higher image density, in particular, higher resolution and higher tone reproduction, and nevertheless may cause less stains on the background and less black spots around line images, in particular, can stably form good images for a long period of time even in an environment of low temperature and low humidity.

To achieve the above objects, the present invention provides a magnetic toner comprising a binder resin and a magnetic material, wherein;

The magnetic toner has a volume average particle diameter of not more than 9 μm and the variation coefficient, $(\sigma T/D)\times 100$, satisfies the following condition:

$$25 \leqq (\sigma T/D)\times 100 \leqq 35$$

wherein D represents a volume average particle diameter (μm) of the magnetic toner and $\sigma T$ represents a value of standard deviation of the volume particle size distribution of the magnetic toner; and said magnetic material has a number average particle diameter of from 0.1μm to 0.2 μm and the variation coefficient, $(\sigma/\overline{X})\times 100$, satisfies the following condition:

$$(\sigma/\overline{X})\times 100 \leqq 40$$

wherein $\overline{X}$ represents a number average particle diameter (μm) of the magnetic material and $\sigma$ represents a value of standard deviation of the number particle size distribution of the magnetic material.

DESCRIPTION OF THE PREFERRED EMBODIMENTS

In the present invention, the number average particle diameter of the magnetic material and the variation coefficient of particle size distribution are obtained by magnifying four times a ten thousand (10,000) magnification photograph of a magnetic material, taken with a transmission type electron microscope, to prepare a forty thousand (40,000) magnification photograph, thereafter selecting 250 magnetic particles at random, actually measuring diameters thereof, and then calculating number particle size distribution based on the diameters and the number of particles.

The variation coefficient is obtained by determining the standard deviation $\sigma$ of particle size distribution of the magnetic material, and multiplying by 100 a value obtained by dividing the standard deviation by an average value $\overline{X}$.

As to the particle shape of a magnetic material, a magnetic material is regarded as a spherical magnetic material when magnetic particles with curved surfaces are contained (as a main component) in a proportion of 50% or more in the 250 particles. It is regarded as an octahedral magnetic material when magnetic particles with triangular surfaces are contained (as a main component) in a proportion of 50% or more in the 250 particles. It is also regarded as a hexagonal magnetic material when magnetic particles that substantially look like squares are contained (as a main component) in a proportion of 50% or more in the 250 particles As magnetic characteristics, the magnetic material may preferably have a coercive force (Hc) of from 60 to 100 Oe, a saturation magnetization ($\sigma s$) of from 50 to 70 emu/g and a residual magnetization ($\sigma r$) of from 5 to 10 emu/g, when measured in a magnetic field of 1 kOe.

The volume average particle diameter of the magnetic toner is calculated from particle size distribution measured using a Coulter counter (TA-II), a particle size distribution measuring device, where an aperture of 100 μm is used.

Not so much attention has been hitherto paid to the particle diameter of magnetic materials, in particular, the particle size distribution thereof. A greatest reason therefor is that magnetic materials have been only studied mainly from the viewpoints of the transport performance of a toner and the improvement in dispersibility thereof to a binder resin. However, taking account of severe demands for copying machines or printers to make them higher in speed, smaller in size and digital in system, and also the tendency toward smaller particle diameter of magnetic toners that is concerned with demands for higher image quality, the present inventors have approached magnetic materials in a more precise manner and have made intensive studies thereon. As a result, they have accomplished the present invention.

Although not based on a theory, they have found that the particle size distribution of a magnetic toner made to have a smaller particle diameter and the particle diameter and particle size distribution of a magnetic material are related to the stabilization of triboelectricity of a magnetic toner in a developing step and also concerned with the selectivity of magnetic toner particles, black-spots-formation around line images and fixing performance of a magnetic toner.

In particular, it is possible in the present invention to make control so as not to cause an unnecessary increase in the amount of triboelectricity even under circumstances in which a magnetic toner is charged under strong friction with a developing sleeve which is a member that imparts static charge to the magnetic toner. This is due to the fact that employment of the magnetic material having a smaller particle diameter and a more uniform particle size distribution than those of conventional magnetic materials in practical use can bring about uniform presence of more magnetic particles on the magnetic toner surface than in conventional magnetic toners, and hence the respective particle surfaces of the magnetic toner become mutually uniform even in microscopic view. When a conventional magnetic toner is triboelectrically charged by its friction with a developing sleeve, particle surfaces of the magnetic toner are charged in a high degree only at given places when those places come into contact with the developing sleeve have no magnetic material. This tends to result in a magnetic toner with non-uniform static charge. An attempt to obtain the desired effect by increasing the amount of the magnetic material also results in an increase in the magnetic force of each particle of the magnetic toner, and hence the magnetic toner can not be separated from the developing sleeve easily. This may undesirably cause a lowering of image density or make fixing performance poor.

In particular, various problems may occur unless the particle size distribution of the magnetic material is sharper as the particle diameter of magnetic particles has been made smaller. Because of strong agglomerating properties of fine magnetic particles, presence of a large number of fine magnetic particles makes it impossible for them to be well dispersed in the magnetic toner if an apparatus for preparing usual magnetic toners is used, which is not preferable for the fixing performance of the magnetic toner. On the other hand, mixed presence of coarse magnetic particles results in preferential consumption of magnetic toner particles containing coarse magnetic particles, in the course of development, so that the properties of the magnetic toner may change. Hence, it is difficult to stably maintain a high image quality for a long period of time.

When the variation coefficient of particle size distribution, $(\sigma T/D)\times 100$, of the magnetic toner is larger than 35 the problem of a lowering of image density or black spots around line images may caused. A value smaller than 25, of the same may bring about undesirable results in view of production efficiency of the magnetic toner.

The number average particle diameter of the magnetic toner of the present invention is not more than 9 μm, and should preferably be in the range of from 4 to 9 μm.

The number average particle diameter of the magnetic material used in the present invention ranges from 0.1 μm to 0.2 μm. When, the number average particle diameter is less than 0.1 μm, the color of magnetic material becomes clearly reddish, which is not preferable for practical use. It may also result in a poor dispersibility of the magnetic material because of its large agglomeration force and a difficulty for agglomerates to come loose, bringing about problems on the durability of the magnetic toner and the development stability.

When the number average particle diameter of the magnetic material is more than 0.2 μm, it becomes difficult for the magnetic material to be uniformly dispersed in magnetic toner particles, resulting in an increase in non-uniformity of magnetic toner particles having a fine particle diameter. This makes it difficult to stably maintain the halftone and fine-line reproduction of developed images for a long period time in an environment of low temperature and low humidity and also tends to cause black spots around line images and fog. In particular, an image with long-term stability can be obtained with difficulty in the high-speed development. The number average particle diameter of the magnetic material may preferably be in the range of from 0.14 to 0.19 μm, and more preferably from 0.15 to 0.19 μm.

When the variation coefficient of particle size distribution of the magnetic material is more than 40, it may sometimes result in a lowering of fixing performance of the magnetic toner, and may cause variation of image quality in the course of the duration for copying or printing for a long period of time, also bringing about a problem on the fine-line reproduction. It may also sometimes results in a lowering of image density in the course of the duration for copying or printing in an environment of low temperature and low humidity. This is presumed to be a problem concerned with the dispersion of the magnetic material.

The variation coefficient of particle size distribution of the magnetic material may preferably be not more than 35, more preferably not more than 30, still more preferably not more than 25, and still more preferably not more than 20.

The magnetic material may preferably have a bulk density of not less than 0.60 g/cc, more preferably not less than 0.70 g/cc, still more preferably not less than 0.80 g/cc, and still more preferably not less than 0.90 g/cc. Particularly when the magnetic material has a particle diameter of 0.2 μm or less, and more particularly 0.18 μm or less, the magnetic material tends to hold air between magnetic particles. Hence, a magnetic material with a higher bulk density allows easier application of shear when it is melt-kneaded, and is preferable for the dispersion of the magnetic material. The bulk density is measured using Powder tester (trade name) manufactured by Hosokawa Micron Corporation.

The magnetic material particles may preferably be octahedral, spherical or hexahedral, and particularly octahedral is preferable.

The binder resin of the magnetic toner includes homopolymers of styrene or its derivatives, or copolymers thereof, as exemplified by polystyrene, poly-p-chlorostyrene, polyvinyl toluene, a styrene/p-chlorostyrene copolymer, and a styrene/vinyl toluene copolymer; copolymers of styrene and an acrylate as exemplified by a styrene/methyl acrylate copolymer, a styrene/ethyl acrylate copolymer, and a styrene/n-butyl acrylate copolymer; copolymers of styrene and an methacrylate as exemplified by a styrene/methyl methacrylate copolymer, a styrene/ethyl methacrylate copolymer, and a styrene/n-butyl methacrylate copolymer; terpolymers of styrene, an acrylate and a methacrylate; styrene copolymers of styrene and other vinyl monomer as exemplified by a styrene/acrylonitrile copolymer, a styrene/-methyl vinyl ether copolymer, a styrene/butadiene copolymer, a styrene/methyl vinyl ketone copolymer, a styrene/acrylonitrile/indene copolymer, and a styrene/maleate copolymer; polymethyl methacrylate, polybutyl methacrylate, polyvinyl acetate, polyesters, polyamides, epoxy resins, polyvinyl butyral, polyacrylic acid, phenol resins, aliphatic or alicyclic resin, petrolium resin and chlorinated paraffin. These can be used alone or in the form of a mixture.

In particular, styrene copolymers or polyester resins are preferred as thermally fixable binder resins.

A binder resin used for toners applied in a pressure fixing method includes low-molecular polyethylenes, low-molecular polypropylenes, an ethylene/vinyl acetate copolymer, an ethylene/acrylate copolymer, higher fatty acids, polyamide resins, and polyester resins. These can be used alone or in the form of a mixture.

The polymer, copolymer or polymer blend used may preferably contain a vinyl aromatic monomer as typified by styrene or an acrylic monomer in an amount of not less than 40 wt. %, in view of development performance and fixing performance.

The magnetic material according to the present invention should be used in an amount of from 20 to 150 parts by weight, and preferably from 30 to 120 parts by weight, based on 100 parts by weight of the binder resin.

In the magnetic toner, any suitable dye or pigment may be used in addition to the magnetic material. It includes, for example, conventionally known dyes or pigments such as carbon black, Phthalocyanine Blue, ultramarine, Quinacridone, and Benzidine Yellow.

Additives may be optionally mixed in the magnetic toner. Such additives include, for example, hydrophobic colloidal fine silica powder, Teflon powder, fluidizing agents or lubricants such as zinc stearate, and metal oxides such as tin oxide serving as a conductivity-providing agent.

The magnetic material includes ferromagnetic elements such as iron, cobalt and nickel; alloys or compounds of iron, cobalt, nickel and/or manganese, such as magnetite, maghemite and ferrite; and other ferromagnetic alloys.

Among these magnetic materials, magnetite will be described below:

(A) Spherical magnetite:

Magnetite particles having spherical shape can be obtained by carrying out reaction comprised of two stages; In a first stage an aqueous ferrous salt solution and an aqueous alkaline solution of less than equivalent to $Fe^{2+}$ of the aqueous ferrous salt solution are mixed to form a suspension containing ferrous hydroxide of a temperature of from 70° to 100° C., and, while heating the suspension at a temperature ranging from 70° to 100°, an oxygen-containing Gas is passed to form magnetite particles. In a second stage after completion of the first stage reaction, an aqueous alkaline solution of equivalent to remaining $Fe^{2+}$ or more is added to carry out thermal oxidation under the same conditions as in the first stage reaction. The magnetite particles having spherical shape, thus obtained, have a fine particle size and also have a sharp particle size distribution and a small variation coefficient thereof.

As an alkali component of the aqueous alkaline solution, it is possible to use a hydroxide of an alkali metal as exemplified by sodium hydroxide or potassium hydroxide, and a hydroxide of an alkaline earth metal as exemplified by magnesium hydroxide or calcium hydroxide.

In the suspension containing ferrous hydroxide, a water-soluble silicate such as sodium silicate or potassium silicate may preferably be contained in an amount of from 0.1 to 5.0 atom % in terms of Si, based on $Fe^{2+}$ whereby it is possible to further improve the sphericity, particle size distribution and temperature stability of the resulting magnetite particles.

The preparation of the spherical magnetite particles used in the present invention will be detailed below in the form of experiments.

Experiment 1

An air-bubble oxidation type reaction column of 35 cm in diameter and 50 lit in internal volume was used as a reactor. Using 20 lit of an aqueous ferrous sulfate solution containing 1.6 mol/lit of $Fe^{2+}$, 20 lit of an aqueous 3.07N sodium hydroxide solution (corresponding to 0.96 equivalent weight based on $Fe^{2+}$) and 20.2 g (0.3 atom % based on Fe) of sodium silicate (#3) ($SiO_2$ content: 28.55 wt. %), a suspension containing $Fe(OH_2)$ was formed at a temperature of 82° C.

The temperature of the above suspension containing $Fe(OH_2)$ was raised to 85° C., and thereafter 100 lit per minute of air was passed for 240 minutes to form magnetite particles. Subsequently, 2 lit of an aqueous 1.34N NaOH solution (corresponding to 1.05 equivalent weight based on remaining $Fe^{2+}$) was added, and 100 lit per minute of air was further passed for 30 minutes at a temperature of 85° C. Magnetite particles thus formed were subjected to washing with water, filtration, drying and disintegration according to conventional methods. The resulting magnetite particles were examined under an electron microscope to confirm that they were spherical and had a number average particle diameter of 0.18 μm and a variation coefficient of 18. This is designated as magnetic material (magnetite) A. Of the above reaction conditions, the $Fe^{2+}$ concentration, temperature, alkali equivalent ratio, and amount of sodium silicate in the formation of the suspension containing ferrous hydroxide, and the temperature and flow rate of air in the oxidation conditions were changed to obtain magnetic materials (magnetite) B to K, but otherwise in the same way as in Experiment 1. Table 1 shows the reaction conditions and the number average particle diameters and variation coefficients of particle size distribution of the magnetites formed.

TABLE 1

| | Formation of $Fe(OH)_2$ colloid | | | | Oxidation conditions | | | |
|---|---|---|---|---|---|---|---|---|
| (1) | Temp. (°C.) | Fe conc. (mol/l) | Alkali equiv. ratio | Si/Fe (at %) | Temp. (°C.) | Air flow rate (l/min) | (2) (μm) | (3) |
| A | 82 | 0.8 | 0.96 | 0.3 | 85 | 100 | 0.18 | 18 |
| B* | 60 | 0.8 | 0.98 | 0.3 | 90 | 100 | 0.23 | 41 |
| C | 84 | 0.8 | 0.93 | 2.0 | 90 | 100 | 0.16 | 19 |
| D* | 53 | 0.8 | 0.98 | 0.5 | 90 | 80 | 0.25 | 45 |
| E | 79 | 0.8 | 0.97 | 0.5 | 85 | 100 | 0.19 | 26 |
| F* | 65 | 0.8 | 0.97 | 0.2 | 95 | 80 | 0.24 | 42 |
| G | 76 | 0.6 | 0.95 | 0.5 | 80 | 120 | 0.12 | 36 |
| H | 73 | 0.8 | 0.90 | — | 80 | 100 | 0.14 | 32 |
| I | 81 | 0.8 | 0.85 | 1.0 | 85 | 100 | 0.14 | 23 |
| J* | 73 | 0.6 | 0.81 | 1.0 | 75 | 150 | 0.09 | 30 |
| K* | 79 | 0.8 | 0.97 | — | 95 | 100 | 0.23 | 25 |

(1): Magnetic material (magnetite)
(2): Number average particle diameter
(3): Variation coefficient
*Comparative example (B) Octahedral magnetite:

Magnetite particles having octahedral shape can be obtained by mixing an aqueous ferrous salt solution and an aqueous alkaline solution to form a suspension of a temperature of from 70° to 100° C. and pH 10 or more, which contains ferrous hydroxide, and then passing an oxygen-containing gas through the suspension. The magnetite particles having octahedral shape can be desirably formed by selecting the conditions for their formation as in Experiment 2 described below.

As an alkali component of the aqueous alkaline solution, it is possible to use a hydroxide of an alkali metal as exemplified by sodium hydroxide or potassium hydroxide, and a hydroxide of an alkaline earth metal as exemplified by magnesium hydroxide or calcium hydroxide.

In the suspension containing ferrous hydroxide, a water-soluble silicate such as sodium silicate or potassium silicate may preferably be contained in an amount of from 0.1 to 2.0% by weight in terms of $SiO_2$, based on the magnetite particles to be formed, whereby it is possible to make the particle size distribution of the magnetite particles having octahedral shape sharper.

An oxygen-containing gas may be passed through the suspension obtained by mixing an aqueous alkaline solution and an aqueous ferrous salt solution, containing ferrous hydroxide and having a temperature of from 70° to 100° C. and pH 10 or more, while heating, it. Magnetite particles with octahedral shape can be obtained, having a fine particle diameter of the magnetic material, a sharp particle size distribution, and a small variation coefficient.

The synthesis of the octahedral magnetite particles used in the present invention will be detailed in Experiment 2 below.

Experiment 2

An air-bubble oxidation type reaction column of 35 cm in diameter and 50 lit in internal volume was used as a reactor. Using 20 lit of an aqueous ferrous sulfate solution containing 1.75 mol/lit of $Fe^{2+}$ 18 lit of an aqueous 4N sodium hydroxide solution and 18.9 g (corresponding to 0.23% by weight in terms of $SiO_2$, based on the magnetite particles formed) of sodium silicate (#3) ($SiO_2$ content: 28.55 wt. %), a suspension containing 42 lit of $Fe(OH_2)$ was prepared at a temperature of 88° C. and pH 13.

At a temperature of 90° C., 100 lit per minute of air was passed for 120 minutes through the above suspension containing $Fe(OH_2)$ to form black precipitates. Particles thus formed were subjected to washing with water, filtration, drying and disintegration according to conventional methods. The resulting magnetite particles were examined under an electron microscope to confirm that they had a number average particle diameter of 0.16 μm, a variation coefficient of 19, and had octahedral shape. This is designated as magnetic material (magnetite) L. Of the above reaction conditions, the $Fe^{2+}$ concentration, temperature, pH, and amount of sodium silicate at the formation of the suspension containing ferrous hydroxide, and the temperature and flow rate of air in the oxidation conditions were changed to obtain octahedral magnetic materials (magnetite) M to U in otherwise the same way as in Experiment 2. Table 2 shows the reaction conditions and the number average particle diameters and variation coefficients of particle size distribution of the magnetites formed.

TABLE 2

| | Formation of $FE(OH)_2$ colloid | | | | Oxidation conditions | | | |
|---|---|---|---|---|---|---|---|---|
| (1) | Temp. (°C.) | Fe conc. (mol/l) | pH | $SiO_2/Fe_3O_4$ (wt %) | Temp. (°C.) | Air flow rate (l/min) | (2) (μm) | (3) (3) |
| L | 88 | 0.8 | 13.0 | 0.23 | 90 | 100 | 0.16 | 19 |
| M* | 88 | 0.9 | 13.7 | 5.0 | 95 | 100 | 0.22 | 42 |
| N | 86 | 0.9 | 13.0 | — | 90 | 100 | 0.19 | 24 |
| O* | 60 | 0.8 | 13.7 | — | 90 | 100 | 0.17 | 41 |
| P | 83 | 0.8 | 13.2 | — | 90 | 100 | 0.18 | 21 |
| Q | 88 | 0.9 | 13.3 | — | 90 | 100 | 0.19 | 21 |
| R | 92 | 0.8 | 13.5 | — | 90 | 100 | 0.16 | 20 |
| S | 81 | 0.6 | 13.4 | — | 85 | 120 | 0.12 | 19 |
| T* | 63 | 0.9 | 13.7 | — | 90 | 100 | 0.21 | 35 |
| U* | 88 | 0.9 | 13.0 | 0.23 | 95 | 100 | 0.23 | 23 |

(1): Magnetic material (magnetite)
(2): Number average particle diameter
(3): Variation coefficient
*Comparative example (C) Hexahedral magnetite:

Magnetite particles having hexahedral shape can be obtained by mixing an aqueous ferrous salt solution and an aqueous alkaline solution to form a suspension of a temperature of from 70° to 100° C. and pH 8 or more, which contains ferrous hydroxide, and then passing an oxygen-containing gas through the suspension. The magnetite particles having hexahedral shape can be desirably formed by selecting conditions for their formation as in Experiment 3 described below.

As an alkali component of the aqueous alkaline solution, it is possible to use a hydroxide of an alkali metal as exemplified by sodium hydroxide or potassium hydroxide, and a hydroxide of an alkaline earth metal as exemplified by magnesium hydroxide or calcium hydroxide.

In the suspension containing ferrous hydroxide, a water-soluble silicate such as sodium silicate or potassium silicate may preferably be contained in an amount of from 0.1 to 2.0% by weight in terms of $SiO_2$, based on the magnetite particles to be formed, whereby it is possible to further improve the particle size distribution of the magnetite particles having hexahedral shape.

An oxygen-containing gas may be passed through the suspension obtained by mixing an aqueous alkaline solution and an aqueous ferrous salt solution, containing ferrous hydroxide and having a temperature of from 70° to 100° C. and pH 8 or more, while heating, it. Magnetite particles with hexahedral shape can be thus obtained, having a fine particle diameter, a sharp particle size distribution, and a small variation coefficient.

The synthesis of the hexahedral magnetite particles used in the present invention will be detailed in Experiment 3 below.

Experiment 3

An air-bubble oxidation type reaction column of 35 cm in diameter and 50 lit in internal volume was used as a reactor. Using 20 lit of an aqueous ferrous sulfate solution containing 1.75 mol/lit of $Fe^{2+}$ 15 lit of an aqueous 4N sodium hydroxide solution and 18.9 g (corresponding to 0.23% by weight in terms of $SiO_2$, based on the magnetite particles formed) of sodium silicate (#3) ($SiO_2$ content: 28.55 wt. %), a suspension containing 42 lit of $Fe(OH_2)$ was prepared at a temperature of 88° C. and pH 8.5.

At a temperature of 90° C., 100 lit per minute of air was passed for 120 minutes through the above suspension containing $Fe(OH_2)$ to form black precipitates. Particles thus formed were subjected to washing with water, filtration, drying and disintegration according to conventional methods. The resulting magnetite particles were observed with an electron microscope to confirm that they had a number average particle diameter of 0.17 μm, a variation coefficient of 18.5, and had hexahedral shape. This is designated as magnetic material (magnetite) A-2. Of the above reaction conditions, the $Fe^{2+}$ concentration, temperature, pH, and amount of sodium silicate at the formation of the suspension containing ferrous hydroxide, and the temperature and flow rate of air in the oxidation conditions were changed to obtain hexahedral magnetic materials (magnetite) B-2 and C-2 in otherwise the same way as in the above. Table 3 shows the reaction conditions and the number average particle diameter and variation coefficient of particle size distribution of the magnetites formed.

TABLE 3

| Magnetic material | Number average particle diameter (μm) | Variation coefficient | σT (emu/g) | Bulk density (g/cm³) |
|---|---|---|---|---|
| A-2 | 0.17 | 18.5 | 7.0 | 0.75 |
| B-2 | 0.18 | 20 | 8.0 | 0.62 |
| C-2* | 0.35 | 30 | 5.4 | 0.58 |

*Comparative example

Using the respective magnetic materials as described above, magnetic toners were prepared. In the following examples, "part(s)" refers to "part(s) by weight".

Example 1

Styrene/acrylate copolymer (binder resin) 100 parts
Negative chargeability control agent 0.5 part
Release agent 6 parts
Magnetic material A 80 parts The above materials were subjected to powder mixing. The resulting powdery mixture was heat-kneaded for about 15 minutes using a roll mill set to 150° C., and cooled, followed by crushing and then fine grinding (a jet mill). The product was further classified by means of a zig-zag classifier manufactured by Alpine Co. to remove those beyond the limits. A negatively chargeable magnetic toner with insulating properties was thus obtained, having a volume average particle diameter D of 8.2 μm and a variation coefficient of particle size distribution, $(\sigma T/D)\times 100$, of 30 as measured using a Coulter counter TA-II, manufactured by Coulter Electronics Co.

Then, 100 parts of the resulting magnetic toner and 0.5 part of negatively chargeable hydrophobic colloidal fine silica powder were mixed to prepare a magnetic toner having hydrophobic colloidal silica particles on the surfaces of toner particles. This toner was evaluated using a copying machine NP-8580, manufactured by Canon Inc.

As a result, image density, fine-line reproduction and tone reproduction were found stable and very good even after the duration of 150,000 sheet copying in a normal environment. In particular, fine lines were reproduced in a resolution of not less than 6 lines/mm in a stable state, without fog and also without any problem of black spots around line images.

In addition, even in a continuous image reproduction test in an environment of low temperature and low humidity, no charge-up phenomenon occurred, no fog appeared, and both the image density and the image quality were good and stable.

Comparative Example 1

A magnetic toner was prepared in the same manner as in Example 1 except that the magnetic material A in Example 1 was replaced with the magnetic material B. The resulting magnetic toner had a volume average particle diameter D of 8.1 μm and a variation coefficient of particle size distribution, $(\sigma T/D)\times 100$, of 31.

The magnetic toner was evaluated in the same manner as in Example 1. In the durability test carried out in a normal environment, results were on substantially a good level from the viewpoint of practical use, but fog tended to slightly appear. Black spots around line images were also seen, and fine-line reproduction and tone reproduction were a little lowered after the duration of about 100,000 sheet copying. In the test carried out in an environment of low temperature and low humidity, the charge-up phenomenon a little occurred, which caused appearance of fog. Tone reproduction was lowered with the duration of copying, and fixing performance became a little poor.

Example 2

| | |
|---|---|
| Styrene/acrylate copolymer (binder resin) | 100 parts |
| Negative chargeability control agent | 0.5 part |
| Release agent | 4 parts |
| Magnetic material C | 80 parts |

Using the above materials, a magnetic toner was prepared in the same manner as in Example 1. The resulting magnetic toner had a volume average particle diameter D of 7.5 μm and a variation coefficient of particle size distribution, $(\sigma T/D)\times 100$, of 27. Then, 100 parts of the magnetic toner and 0.5 part of hydrophobic colloidal fine silica powder were mixed, and the resulting toner was put in a laser beam printer LBP-8II, manufactured by Canon Inc., to make evaluation. As a result, digital latent images were faithfully reproduced from the initial stage of printout until the magnetic toner ran out (4,000 to 5,000 sheet printing). In particular, resolution and halftone reproduction were found very good and stable. Image density was also as high as 1.4 to 1.45, without fog and black spots around line images. Developing performance was stable.

In particular, even in a durability test carried out in an environment of low temperature and low humidity, the developing performance was stable and no fog appeared on the background. A cartridge containing the toner was further left to stand for about 3 months under a condition of a low temperature and low humidity, and then an image reproduction was carried out. There, however, was no problem, and good image quality and good image density were stably maintained.

Comparative Example 2

A magnetic toner was prepared in the same manner as in Example 2 except that the magnetic material C in Example 2 was replaced with the magnetic material D. The resulting magnetic toner had a volume average particle diameter D of 7.9 μm and a variation coefficient of particle size distribution, $(\sigma T/D)\times 100$, of 28.

This magnetic toner was evaluated in the same manner as in Example 2. As a result, resolution and halftone reproduction somewhat lowered as the toner started to run-out.

In a durability test in an environment of low temperature and low humidity,. image density a little lowered with the duration of printing. This means that the fine lines became gradually thinner than those at the initial stage. In the course of the durability test, fog on the background slightly appeared and also fixing performance became poor.

Example 3

| | |
|---|---|
| Styrene/acrylate copolymer (binder resin) | 100 parts |
| Positive chargeability control agent | 2 part |
| Release agent | 3 parts |
| Magnetic material E | 75 parts |

Using the above materials, a positively chargeable magnetic toner with insulating properties was prepared. The resulting magnetic toner had a volume average particle diameter D of 8.9 μm and a variation coefficient of particle size distribution, $(\sigma T/D)\times 100$, of 26. Then, 100 parts of the magnetic toner and 0.5 part of positively chargeable hydrophobic colloidal fine silica powder were mixed, and the resulting toner was evaluated using a digital copying machine NP-9030 (a reversal development system), manufactured by Canon Inc.

As a result, in a durability test in a normal environment, image density was as high as 1.4 or more from its initial stage up to 50,000 sheet copying. In particular, resolution and halftone reproduction were found good, without fog and black spots around line images, showing that developed images were stable. The resolution and the halftone were particularly good.

Even in a durability test carried out in an environment of low temperature and low humidity, developing performance was similarly good and stable. In particular, fine lines of digital latent images were reproduced in a good resolution, and there was no fog.

Comparative Example 3

A magnetic toner was prepared in the same manner as in Example 3 except that the magnetic material E in Example 3 was replaced with the magnetic material F. The resulting magnetic toner had a volume average particle diameter D of 8.8 μm and a variation coefficient of particle size distribution, $(\sigma T/D)\times 100$, of 27.

This magnetic toner was evaluated in the same manner as in Example 3. As a result, in the durability test carried out in a normal environment, there was substantially no problem from the viewpoint of practical use, but resolution and halftone reproduction a little lowered with an increase in the number of copy sheets in the durability test, and at the same time black spots around line images appeared.

In durability tests continuously carried out in an environment of low temperature and low humidity, fog slightly appeared and also image density a little lowered with the duration of copying. In particular, fine-line images became a little thinner and also fixing performance became poor with an increase in the number of copy sheets in the durability test.

Examples 4 to 6 & Comparative Examples 4 to 5

Magnetic toners were prepared in the same manner as in Example 2 except that the magnetic material C in Example 2 was replaced with the magnetic materials G to K, respectively. Evaluation was also made in the same way. The respective magnetic toners had a volume average particle diameter D of 9 μm or less and a variation coefficient of particle size distribution, $(\sigma T/D)\times 100$, in the range of from 25 to 35. Results obtained are shown in Table 4.

TABLE 4

| | Magnetic material | | | | Magnetic toner | | | Environment of normal temp. and normal humidity | | | | | | |
|---|---|---|---|---|---|---|---|---|---|---|---|---|---|---|
| | Type | (1) (μm) | (2) $\sigma/\overline{X}$ x100 | Bulk density | (3) (μm) | (2) $\sigma T/D$ x100 | Machine used | Image density | Fine line | Half-tone | Fog | (4) | Sta-bility | L.L.* (5) |
| Ex-1 | A | 0.18 | 18 | 0.93 | 8.2 | 30 | NP-8580 | 1.4 | AA | AA | AA | A | AA | No |
| CEx-1 | B | 0.23 | 41 | 0.50 | 8.1 | 31 | " | 1.3 | A | A | AB | B | A | Yes |
| Ex-2 | C | 0.16 | 19 | 0.90 | 7.5 | 27 | LBP-8 II | 1.4 | AA | AA | AA | AA | AA | No |
| CEx-2 | D | 0.25 | 45 | 0,56 | 7.9 | 28 | " | 1.25 | AB | AB | A | AB | AB | Yes |
| Ex-3 | E | 0.19 | 26 | 0.85 | 8.9 | 26 | NP-9030 | 1.4 | AA | AA | AA | AA | AA | No |
| CEx-3 | F | 0.24 | 42 | 0.70 | 8.8 | 27 | " | 1.3 | A | A | AB | B | AB | Yes |
| Ex-4 | G | 0.12 | 36 | 0.80 | 8.0 | 27 | LBP-8 II | 1.35 | AA | AA | A | AA | AA | No |
| Ex-5 | H | 0.14 | 32 | 0.85 | 8.3 | 26 | " | 1.37 | AA | AA | A | AA | AA | No |
| Ex-6 | I | 0.14 | 23 | 0.92 | 8.2 | 28 | " | 1.4 | AA | AA | AA | AA | AA | No |
| CEx-4 | J | 0.09 | 30 | 0.58 | 7.9 | 31 | " | 1.1 | B | B | A | B | B | Yes |

TABLE 4-continued

| | Magnetic material | | | | Magnetic toner | | | Environment of normal temp. and normal humidity | | | | | | |
|---|---|---|---|---|---|---|---|---|---|---|---|---|---|---|
| | Type | (1) (μm) | (2) σ/X̄ x100 | Bulk density | (3) (μm) | (2) σT/D x100 | Machine used | Image density | Fine line | Half-tone | Fog | (4) | Sta-bility | L.L.* (5) |
| CEx-5 | K | 0.23 | 25 | 0.70 | 8.5 | 32 | " | 1.3 | A | A | AB | AB | AB | Yes |

Ex-: Example, CEx-: Comparative Example
*Low-temperature and low-humidity environment
(1): Number average particle diameter
(2): Variation coefficient
(3): Volume average particle diameter
(4): Black spots around line images
(5): Problems caused by charge-up
Evaluation criterions: AA: Excellent, A: Good, AB: Fair, B: Acceptable in practical use

Example 7

| | |
|---|---|
| Styrene/acrylate copolymer (binder resin) | 100 parts |
| Negative chargeability control agent | 0.5 part |
| Release agent | 6 parts |
| Magnetic material L | 80 parts |

The above materials were subjected to powder mixing. The resulting powdery mixture was heat-kneaded for about 20 minutes using a roll mill set to 140° C., and cooled, followed by crushing and then fine grinding (a jet mill). The product was further classified by means of a zig-zag classifier manufactured by Alpine Co. to remove those beyond the limits. A negatively chargeable magnetic toner with insulating properties was thus obtained, having a volume average particle diameter D of 8.1 μm and a variation coefficient of particle size distribution, $(\sigma T/D)\times 100$, of 29 as measured using a Coulter counter TA-II, manufactured by Coulter Electronics Co.

Then, 100 parts of the resulting magnetic toner and 0.5 part of negatively chargeable hydrophobic colloidal fine silica powder were mixed to prepare a magnetic toner having hydrophobic colloidal silica particles on the surfaces of toner particles. This toner was evaluated using a copying machine NP-8580, manufactured by Canon Inc.

As a result, image density, fine-line reproduction and tone reproduction were found stable and very good even after the duration of 150,000sheet copying in a normal environment. In particular, fine lines were stably reproduced in a resolution of 5.5~6 lines/mm, without fog end also without any problem of black spots around line images.

In addition, even in a continuous image reproduction test in an environment of low temperature and low humidity, no charge-up phenomenon occurred, no fog appeared, and both the image density and the image quality were good and stable.

Comparative Example 6

A magnetic toner was prepared in the same manner as in Example 7 except that the magnetic material used in Example 7 was replaced with the magnetic material M. The resulting magnetic toner had a volume average particle diameter D of 8.0 μm and a variation coefficient of particle size distribution, $(\sigma T/D)\times 100$, of 30.

The magnetic toner was evaluated in the same manner as in Example 7.

In the durability test carried out in a normal environment, the results were on substantially a good level from the viewpoint of practical use, but fine-line reproduction and tone reproduction a little lowered after the duration of about 100,000 sheet copying.

In the test carried out in an environment of low temperature and low humidity, the charge-up phenomenon a little occurred after about 30,000 sheet copying, which caused a little appearance of fog. The tone reproduction lowered with the duration of copying, and the fixing performance became a little poor.

Example 8

| | |
|---|---|
| Styrene/acrylate copolymer (binder resin) | 100 parts |
| Negative chargeability control agent | 0.5 part |
| Release agent | 4 parts |
| Magnetic material N | 80 parts |

Using the above materials, a magnetic toner was prepared in the same manner as in Example 7. The resulting magnetic toner had a volume average particle diameter D of 7.6 μm and a variation coefficient of particle size distribution, $(\sigma T/D)\times 100$, of 33.

Then, 100 parts of the resulting magnetic toner and 0.5 part of hydrophobic colloidal fine silica powder were mixed, and the resulting toner was put in a laser beam printer LBP-8II, manufactured by Canon Inc., to make evaluation.

As a result, digital latent images were faithfully reproduced from the initial stage of printout until the magnetic toner ran out (4,000 to 5,000 sheet printing). Resolution and halftone reproduction were found very good and stable.

Image density was also as high as 1.38 to 1.4, without fog and black spots around line images. Developing performance was stable. In particular, even in a durability test carried out in an environment of low temperature and low humidity, the developing performance was stable and no fog appeared on the background. A cartridge containing the toner was further left to stand for about 3 months under conditions of a low temperature and low humidity, and then an image reproduction was carried out. There, however, was no problem, and the good image quality and good image density were stably maintained.

Comparative Example 7

A magnetic toner was prepared in the same manner as in Example 8 except that the magnetic material N in Example 8 was replaced with the magnetic material O. The resulting magnetic toner had a volume average particle diameter D of 7.7 μm and a variation coefficient of particle size distribution, $(\sigma T/D)\times 100$, of 31.

This magnetic toner was evaluated in the same manner as in Example 8. As a result, the resolution and halftone reproduction lowered at the near run-out of the toner in a developing cartridge. In a durability test in an environment of low temperature and low humidity, image density a little lowered with the duration of printing. This means that the fine lines became gradually thinner than those at the initial stage. In the course of the durability test, fog on the background slightly appeared and also the fixing performance became poor.

Example 9

| | |
|---|---|
| Styrene/acrylate copolymer (binder resin) | 100 parts |
| Positive chargeability control agent | 2 part |
| Release agent | 3 parts |
| Magnetic material P | 70 parts |

Using the above materials, a positively chargeable magnetic toner with insulating properties was prepared. The resulting magnetic toner had a volume average particle diameter D of 9.0 μm and a variation coefficient of particle size distribution, $(\sigma T/D)\times 100$, of 26. Then, 100 parts of the magnetic toner and 0.5 part of positively chargeable hydrophobic colloidal fine silica powder were mixed, and the resulting toner was evaluated using a digital copying machine NP-9030 (a reversal development system), manufactured by Canon Inc.

As a result, in a durability test in a normal environment, image density was as high as 1.35 or more from its initial stage up to 50,000 sheet copying. In particular, the resolution and halftone reproduction were found good, without fog and black spots around line images, showing that developed images were stable. No fog and no black spots around line images were particularly seen. Even in a durability test carried out in an environment of low temperature and low humidity, the developing performance was similarly good and stable. In particular, fine lines of digital latent images were reproduced in a good resolution, and there was no fog.

Comparative Example 8

A magnetic toner was prepared in the same manner as in Example 9 except that the magnetic material P in Example 9 was replaced with the magnetic material Q. The resulting magnetic toner had a volume average particle diameter D of 8.9 μm and a variation coefficient of particle size distribution, $(\sigma T/D)\times 100$, of 27.

This magnetic toner was evaluated in the same manner as in Example 9. As a result, in the durability test carried out in a normal environment, the resolution and halftone reproduction a little lowered with an increase in the number of copy sheets in the durability test after 40,000 sheet copying, though in a degree of little matter from the viewpoint of practical use. In durability tests continuously carried out in an environment of low temperature and low humidity, fog slightly appeared and also the image density a little lowered with the duration of copying. In particular, a little black spots around fine-line images appeared, the image quality lowered and also fixing performance became poor with the duration of copying.

Examples 10 to 12 & Comparative Examples 9, 10

Magnetic toners were prepared in the same manner as in Example 8 except that the magnetic material N in Example 8 was replaced with the magnetic materials R to U, respectively. Evaluation was also made in the same way. Results obtained are shown in Table 5.

TABLE 5

| | Magnetic material | | | | Magnetic toner | | | Environment of normal temp. and normal humidity | | | | | | |
|---|---|---|---|---|---|---|---|---|---|---|---|---|---|---|
| | Type | (1) (μm) | (2) $\sigma/\bar{X}$ x100 | Bulk density | (3) (μm) | (2) $\sigma T/D$ x100 | Machine used | Image density | Fine line | Half-tone | Fog | (4) | Sta-bility | L.L.* (5) |
| Ex-7 | L | 0.16 | 19 | 0.72 | 8.1 | 29 | NP-8580 | 1.4 | AA | A | AA | A | AA | No |
| CEx-6 | M | 0.22 | 42 | 0.30 | 8.0 | 30 | " | 1.3 | A | AB | A | B | B | Yes |
| Ex-8 | N | 0.19 | 24 | 0.62 | 7.6 | 33 | LBP-8 II | 1.4 | AA | A | AA | AA | AA | No |
| CEx-7 | O | 0.17 | 41 | 0.40 | 7.7 | 31 | " | 1.23 | AB | AB | A | AB | AB | Yes |
| Ex-9 | P | 0.18 | 21 | 0.58 | 9.0 | 26 | NP-9030 | 1.4 | AA | A | AA | A | AA | No |
| CEx-8 | U | 0.23 | 25 | 0.27 | 8.9 | 27 | " | 1.3 | A | A | AB | B | B | Yes |
| Ex-10 | Q | 0.19 | 21 | 0.60 | 8.1 | 27 | LBP-8 II | 1.4 | AA | AA | AA | AA | AA | No |
| Ex-11 | R | 0.16 | 20 | 0.74 | 8.0 | 27 | " | 1.38 | AA | A | AA | AA | AA | No |
| Ex-12 | S | 0.12 | 19 | 0.50 | 8.3 | 26 | " | 1.35 | AA | A | AA | AA | A | No |
| CEx-9 | T | 0.21 | 23 | 0.50 | 8.6 | 31 | " | 1.3 | A | AB | AA | A | AB | Yes |
| CEx-10 | U | 0.23 | 25 | 0.27 | 7.8 | 30 | " | 1.3 | AB | B | A | AB | A | Yes |

Ex-: Example, CEx-: Comparative Example
*Low-temperature and low-humidity environment
(1): Number average particle diameter
(2): Variation coefficient
(3): Volume average particle diameter
(4): Black spots around line images
(5): Problems caused by charge-up
Evaluation criterions: AA: Excellent, A: Good, AB: Fair, B: Acceptable in practical use Example 13

| | |
|---|---|
| Styrene/acrylate copolymer (binder resin) | 100 parts |
| Negative chargeability control agent | 0.5 part |
| Magnetic material A-2 | 80 parts |

The above materials were subjected to powder mixing. The resulting powdery mixture was heat-kneaded for about 15 minutes using a roll mill set to 140° C., and cooled, followed by crushing and then fine grinding (a jet mill). The product was further classified by means of a zig-zag classifier manufactured by Alpine Co. to remove those beyond the limits. A negatively chargeable magnetic toner with insulating properties was thus obtained, having a volume average particle diameter D of 7.9 μm and a variation coefficient of particle size distribution, $(\sigma T/D)\times 100$, of 28.

Then, 100 parts of the magnetic toner and 0.5 part of hydrophobic colloidal fine silica powder were mixed, and the resulting toner was put in a laser beam printer LBP-8II, manufactured by Canon Inc., which had been modified for speed-up from 8 sheets/min to 10 sheets/-min.

As a result, the magnetic toner showed a good environmental stability. In particular, even in an environment of low temperature and low humidity, it was possible to obtain images having a high image density, a superior duration stability and a superior sharpness, and also free from black spots around line images and stains on the background.

Comparative Example 11

A magnetic toner was prepared in the same manner as in Example 13 except that the magnetic material used in Example 13 was replaced with the magnetic material C-2. The resulting magnetic toner had a volume average particle diameter D of 8.0 μm and a variation coefficient of particle size distribution, of 29.

This magnetic toner was evaluated in the same manner as in Example 13.

As a result, particularly in the continuous image reproduction test carried out in an environment of low temperature and low humidity, the amount of charge increased to cause a lowering of image density, stain on the background, and thick line images.

Comparative Example 12

A magnetic toner was prepared in the same manner as in Example 13 except that the magnetic material A-2 was replaced with magnetic materials B-2, and was evaluated using a high-speed copying machine.

Results obtained in Examples 13, Comparative Example 12 and Comparative Example 11 are shown in Table 6 below.

TABLE 6

| | Magnetic material | Magnetic toner (1) (μm) | Magnetic toner (2) | Machine used | Environmental stability | Duration stability | Image quality |
|---|---|---|---|---|---|---|---|
| Example 13 | A-2 | 7.9 | 28 | LBP-8II* | AA | AA | AA |
| Comparative Example 11 | C-2 | 8.0 | 29 | " | B | BC | B |
| Comparative Example 12 | B-2 | 8.8 | 23 | NP-8580** | A | A | AA |

(1): Volume average particle diameter
(2): Variation coefficient
*Modified machine
**Modified machine (from 80 sheets/min to 90 sheets/min)
Evaluation criterions:
AA: Very good
A: Good
AB: Good for practical use
B: A little problematic
BC: A little poor
C: Poor

We claim:

1. A magnetic toner comprising a binder resin and a magnetic material, wherein:

said magnetic toner has a volume average particle diameter of 4 μm to 9 μm and the variation coefficient of particle size distribution $(\sigma T/D)\times 100$, of said magnetic toner satisfies the following condition:

$$25 \leqq (\sigma T/D)\times 100 \leqq 35$$

wherein D represent a volume average particle diameter (μm) of the magnetic toner and $\sigma T$ represents a value of standard deviation of the volume particle size distribution of the magnetic toner; and said magnetic material has a number average particle diameter of from 0.12 μm to 0.19 μm and the variation coefficient of particle size distribution $(\sigma/X)\times 100$ of said magnetic material satisfies to following condition:

$$(\sigma/\overline{X})\times 100 \leqq 40$$

wherein $\overline{X}$ represents a number average particle diameter (μm) of the magnetic material and $\sigma$ represents a value of standard deviation of the number particle size distribution of the magnetic material.

2. A magnetic toner according to claim 1, wherein said magnetic material is contained in an amount of from 20 to 150 parts by weight based on 100 parts by weight of said binder resin.

3. A magnetic toner according to claim 1, wherein said magnetic material is contained in an amount of from 30 to 120 parts by weight based on 100 parts by weight of said binder resin.

4. A magnetic toner according to claim 1, wherein said magnetic material has a number average particle diameter of from 0.14 to 0.19 μm and a variation coefficient of particle size distribution, of not more than 35.

5. A magnetic toner according to claim 1, wherein said magnetic material has a number average particle diameter of from 0.15 to 0.19 μm and a variation coefficient of particle size distribution, of not more than 25.

6. A magnetic toner according to claim 1, wherein said magnetic material has a variation coefficient of particle size distribution, of not more than 20.

7. A magnetic toner according to claim 1, wherein said magnetic material has a bulk density of not less than 0.60 g/cc.

8. A magnetic toner according to claim 1, wherein said magnetic material has a bulk density of not less than 0.70 g/cc.

9. A magnetic toner according to claim 1, wherein said magnetic material has a bulk density of not less than 0.80 g/cc.

10. A magnetic toner according to claim 1, wherein said magnetic material has a bulk density of not less than 0.90 g/cc.

11. A magnetic toner according to claim 1, wherein said magnetic material is mainly comprised of magnetic particles with octahedral shape.

12. A magnetic toner according to claim 1, wherein said magnetic material is mainly comprised of magnetic particles with spherical shape.

13. A magnetic toner according to claim 1, wherein said magnetic material is mainly comprised of magnetic particles with hexahedral shape.

14. A magnetic toner according to claim 1, wherein said magnetic material has a residual magnetization ($\sigma r$) of from 5 to 10 emu/g when measured in a magnetic field of 1 kOe.

15. A magnetic toner according to claim 1, wherein said magnetic material is formed in a solution containing from 0.1 to 5.0 atom % Si as a water-soluble silicate based on the amount of $Fe^{2+}$ present.

16. A magnetic toner according to claim 1, wherein said magnetic material comprises magnetite particles and contains from 0 1 to 2 0% by weight of silicon atom in terms of $SiO_2$.

17. A magnetic toner according to claim 1, wherein the variation coefficient of particle size distribution of the magnetic material is not more than 36.

18. A magnetic toner according to claim 1, wherein the magnetic material comprises magnetic particles formed by the steps of oxidizing Fe $(OH)_2$ in the presence of an equivalent or less of alkali; and further oxidizing the oxidized Fe $(OH)_2$ in the presence of an equivalent or more of alkali.

* * * * *